United States Patent [19]

McTeague

[11] 4,259,608

[45] Mar. 31, 1981

[54] DIRECT VIEWING STORAGE TARGET HAVING AN ARRAY OF FLUORESCENT DOTS FOR A CATHODE RAY TUBE

[76] Inventor: Gerald E. McTeague, 3750 NW. Olympic Dr., Portland, Oreg. 97229

[21] Appl. No.: 791,269

[22] Filed: Apr. 27, 1977

[51] Int. Cl.[3] ..... H01J 29/18; H01J 29/30; H01J 31/20

[52] U.S. Cl. ..... 313/398; 313/473

[58] Field of Search ..... 313/398, 473

[56] References Cited

U.S. PATENT DOCUMENTS

| | | | |
|---|---|---|---|
| 3,339,099 | 8/1967 | Anderson | 313/398 |
| 3,534,211 | 10/1970 | Lehmann | 252/301.6 R |
| 3,875,457 | 4/1975 | Kazan et al. | 313/466 X |
| 3,956,662 | 5/1976 | McTeague et al. | 313/398 |

*Primary Examiner*—Robert Segal

*Attorney, Agent, or Firm*—Adrian J. La Rue

[57] ABSTRACT

An electron image storage tube is provided with a bistable storage target employing a transparent faceplate on the inside surface of which there is provided a transparent coating of conductive material. A layer of storage dielectric phosphor is disposed onto the coating of conductive material and an array of conductive fluorescent dots in electrical connection with the conductive coating extends through the layer of storage phosphor and beyond the outer surface of the storage phosphor. The conductive fluorescent dots provides collector electrode means for collecting secondary electrons emitted from charge images that have been written onto the storage dielectric phosphor so that such charge images remain as stored information thereon and the conductive fluorescent dots will enable non-stored electron images having a high degree of brightness and the same general or different color to be displayed simultaneously with the stored charge images on the same general area of the target structure.

17 Claims, 9 Drawing Figures

DIRECT VIEWING STORAGE TARGET HAVING AN ARRAY OF FLUORESCENT DOTS FOR A CATHODE RAY TUBE

BACKGROUND OF THE INVENTION

Collector electrodes are known for their use in storage cathode ray tubes for collecting secondary electrons that are emitted from written areas of a storage target by the action of flood or low velocity electrons being attracted to the positively charged written areas to allow bistable operation to take place.

Collector electrodes are part of the target structure in bistable storage targets to form an integral storage target as disclosed in U.S. Pat. Nos. 3,293,433; 3,293,474; 3,339,099; 3,401,293; 3,531,675; 3,956,662 and 3,978,366. The collector electrodes described in these patents are in various forms. One form is that of a conductive coating covering the inside surface of a faceplate with a porous storage dielectric layer disposed thereon so that secondary electrons are collected by the underlying collector electrode through the storage layer as taught by U.S. Pat. No. 3,293,433. Another form of collector electrode is a metallic mesh that is applied onto the inside surface of the faceplate and storage dielectric islands are provided in the mesh openings onto the faceplate surface which is covered in U.S. Pat. No. 3,293,474. The collector electrodes in U.S. Pat. Nos. 3,531,675; 3,956,662 and 3,978,366 cover metal-coated glass projections etched from an inside surface of the glass faceplate, metal particles forming an array of dots connected to a metal coating on the inside surface of the glass faceplate and metal-coated glass bead dots in the form of an array secured to the glass faceplate; these projections, dots and glass bead dots extending through a layer of phosphor dielectric storage material and beyond the top surface of the layer.

The above-described bistable storage targets will operate to display stored and nonstored information, but the displayed nonstored information is not very bright which makes it difficult to compare the nonstored information with stored information.

In order to increase the brightness of the nonstored information, it is known to add fluorescent phosphor material that does not store information to the storage dielectric material as disclosed in U.S. Pat. No. 3,339,099. The storage dielectric material in this patent however, is porous to enable the secondary electrons to be collected by the collector electrode on which the fluorescent phosphor material and storage dielectric material is disposed. This arrangement makes it difficult to process the storage dielectric material into a target layer and this requirement for a porous dielectric storage target limits light output and contrast ratio. In U.S. Pat. No. 3,401,293, the inside surface of the faceplate has cavities in which are located fluorescent phosphor material. A metal coating covers the fluorescent material and storage dielectric material is provided as dots onto the top surface areas of the faceplate adjacent the metal-coated fluorescent material with the metal coating defining the collector electrode. The metal coating of the fluorescent phosphor material acts as a collector and increases the brightness of the nonstored information, but the addition of the metal coating is expensive.

SUMMARY OF THE INVENTION

The present invention relates generally to an electron image storage cathode ray tube and more particularly to a direct viewing bistable storage target which employs a combined bistable storage dielectric and an array of conductive fluorescent dots for use with a storage cathode ray tube. This storage target structure enables light images of stored and nonstored electron images to be produced simultaneously by the storage dielectric and conductive fluorescent dots, respectively, at the same general area of the target with the conductive fluorescent dots also operating as a collector electrode for collecting secondary electrons emitted from the areas of the storage dielectric where information is stored.

The storage target of the present invention is especially useful in a direct viewing bistable storage cathode ray tube of the type which is used as a signal display device of a cathode ray oscilloscope. However, the present cathode ray tube bistable storage target can also be used as the display device of a sonar or radar system. It can also be used in the cathode ray tube of a closed circuit television receiver or in the display tube of a data transmission system for remotely reproducing the displayed information by transmitting electrical signals corresponding to the displayed information over telephone lines, or by microwave communication equipment, or by operating copy equipment for making a permanent copy of the displayed information.

The direct viewing bistable storage target of the present invention is in the form of an insulating support plate of a transparent material having a thin coating of conductive material deposited on one surface thereof. An array of conductive dots is provided on the conductive coating and these conductive dots are made of fluorescent material that has characteristics of a conducting material so as to function as collector electrode means to collect secondary electrons and the ability to emit light when an electron beam impinges thereon, but it does not have the ability to store the information written thereon by the electron beam. A layer of bistable storage dielectric material is deposited onto the conductive coating surrounding the conductive dots, but the dots have exposed top areas for collecting the secondary electrons that are emitted from the written areas of the storage layer and when the dots are engaged by the writing electron beam, they will display nonstored information either when no stored information is being displayed on the bistable storage dielectric material or simultaneously when stored information is being displayed on the bistable storage dielectric material. The density of the storage layer is such that the secondary electrons will not travel therethrough, but they will generally be collected by the conductive fluorescent dots. The conductive fluorescent material must be of sufficient conductivity in order to operate as collector electrode means as well as to also operate as phosphor means, therefore fluorescent material within the range of $10^1$ to $10^7$ ohm-cm. conductivity will provide the dual operation of collector electrode means and phosphor means. Conductive particles of metal can be added to the fluorescent dots to make them more conductive.

As a result of a cathode ray tube employing the storage target of the present invention, such a tube operates in the manner of a conventional high performance cathode ray storage tube having a fast writing rate and high brightness and it is also capable of bistable storage. Thus, the present storage tube is capable of write through operation because it can produce nonstored information at the same location of the storage target as stored information without erasing the stored information. The write through nonstored information can be displayed as a different color from the stored information which provides color contrast therebetween which makes it easier to compare the displayed information; this can be accomplished by selection of the fluorescent material or materials for the dots.

An object of the present invention is to provide a bistable storage target for a cathode ray tube that is provided with bistable storage dielectric material and collector means of conductive fluorescent material which enables stored and nonstored information to be viewed simultaneously on the same display area.

Another object of the present invention is the provision of a cathode ray tube having a bistable storage target which includes storage dielectric material and an array of conductive fluorescent dots connected to an underlying conductive layer defining collector electrode means.

A further object of the present invention is to provide a bistable storage target that is capable of displaying stored and nonstored images simultaneously with the nonstored images being of high brightness.

An additional object of the present invention is the provision of a bistable storage target for use with a cathode ray tube which includes collector electrode means in the form of fluorescent means having conductor characteristics which are connected to a conductive layer over which is disposed a layer of bistable storage dielectric material with the collector electrode means extending through the layer of bistable storage material and having outer ends exposed for collecting secondary electrons emitted from written areas of the layer of storage material.

Still a further object of the present invention is to provide a bistable storage target for use with a cathode ray tube which includes collector electrode means in the form of fluorescent means having semiconductor characteristics and including conductive metal particles to increase the conductivity thereof.

Other objects and advantages of the present invention will be apparent from the following detailed description of certain preferred embodiments thereof including the attached drawings.

BRIEF DESCRIPTION OF THE DRAWINGS

FIGS. *7a* and *7b* are broken perspective views of alternative embodiments of the storage target.

DETAILED DESCRIPTION OF THE INVENTION

Figure 1:
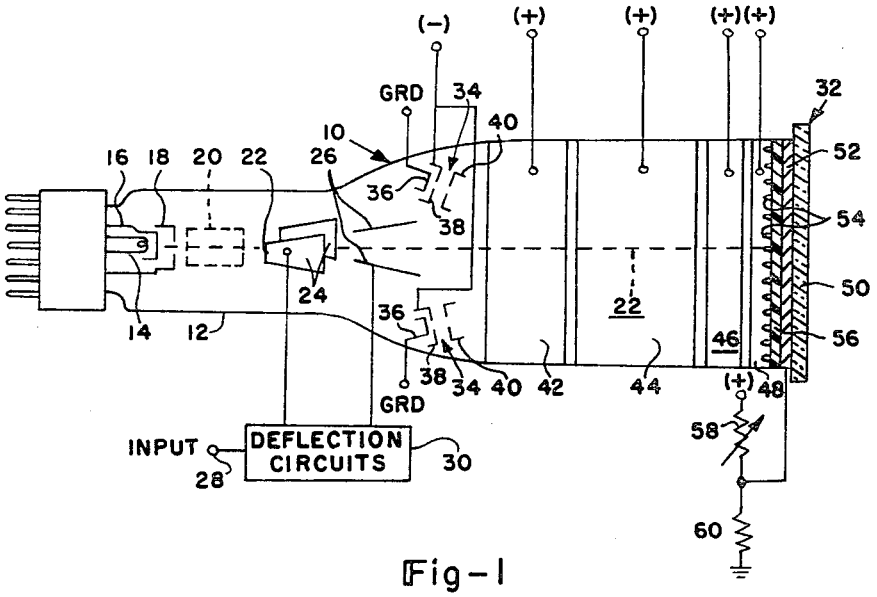
FIG. 1 is a schematic representation of a cathode ray storage tube according to the present invention.

Referring to FIG. 1, a cathode ray storage tube 10 includes an envelope 12 formed of insulating material which houses an electron gun including a filament 14, a cathode 16 for connection to a high negative voltage source, a control grid 18 and a focusing and accelerating structure 20. Electron beam 22 of high velocity electrons produced by the electron gun is deflected horizontally via horizontal deflection plates 24 and vertically by vertical deflection plates 26 in accordance with an input signal applied to input terminal 28 which operates conventional deflection circuits 30 connected to the horizontal and vertical deflection plates so that the electron beam is selectively positioned along storage target 32 at the end of envelope 12 opposite the electron gun in correspondence with the input signal.

One or more flood electron guns 34 is provided in the storage tube, each flood gun including a cathode 36, a control grid 38 and an anode 40. Flood guns 34 are supported inside envelope 12 adjacent output ends of vertical deflection plates 26. Cathodes 36 are conventionally operated at a low voltage level which is typically ground level, whereas grids 38 are connected to a low negative voltage. Low velocity electrons emitted from flood guns 34 diverge into a conically-shaped beam and they are uniformly distributed over target 32.

A plurality of electrodes are disposed on the inner surface of envelope 12 between flood guns 34 and target 32. These electrodes are preferably provided as spaced coatings of conductive material and the first coating 42 functions primarily as a focusing electrode for the flood electrons emitted from the flood guns; it is connected to a suitable source of positive electrical potential. A second electrode wall coating 44 is spaced from coating 42; it is also electrically connected to a positive potential and functions as a focusing and collimating electrode. A third coating electrode 46 is spaced from coating 44, is connected to a positive potential and functions too as a focusing and collimating electrode. As a result of the collimating action of the electrode wall coatings, the electrons from the flood guns 34 are uniformly distributed over the surface target 32.

A fourth electrode wall coating 48 is disposed between and spaced from wall coating 46 and storage target 32 and it is connected to positive voltage. Wall coating 48 also functions as a focusing and collimating electrode for the flood electrons.

Electrodes 42, 44, 46 and 48 are connected to descending positive potentials with the highest positive potential being connected to electrode 42 for optimum operation.

Storage target 32 comprises insulative end plate 50 having a transparent target electrode 52 over which is disposed a series of conductive dots 54 in the form of a dot pattern and a dielectric layer 56. The insulative end plate 50 defines a support member and is made of transparent material, e.g. glass. Target electrode 52 is a thin transparent coating of preferably tin oxide which is suitably connected to the midpoint of a voltage divider which includes resistors 58 and 60 connected between a positive potential and ground. Resistor 58 is variable and is adjusted so that a proper operating voltage is applied to target electrode 52. Alternatively, target electrode 52 may be connected to amplifying means for providing an electrical readout of information stored on the storage target. A dielectric layer can be applied over a peripheral section of target electrode 52 and a portion of collimating electrode 48 nearest to target electrode as taught in U.S. Patent Application Ser. No. 700,278, filed June 28, 1976 in order to obviate illuminating a border area of the viewing area of the target.

Dots 54 are conductive particles, preferably of fluorescent material having conductive characteristics, and they have a preferably substantially conical configuration which have their bases connected to electrode 52 and apices extending outwardly beyond the outer surface of dielectric layer 56. So long as outer areas of dots 54 are exposed, they will operate as collector electrodes. Dots 54 define collector electrodes which will be more fully described hereinafter and the dots can be configurations other than conical, e.g. pyramidal, triangular, etc. Dielectric layer 56 is a phosphor material that is capable of bistable storage operation and preferably P-1 type phosphor or an admixture of P-1 phosphor and yttrium oxide or yttrium oxysulfide or rare earth activated yttrium oxide or yttrium oxysulfide as disclosed in U.S. Patent Application Ser. No. 658,977, filed Feb. 18, 1976. Storage dielectric layer 56 is substantially nonporous, and relative to the porous storage dielectric layer of U.S. Pat. No. 3,339,099, it provides better light output and contrast ratio.

In operation, information is written on storage target 32 via electron beam 22, and it may be in the form of a waveform applied to vertical deflection plates 26 while the beam is scanned horizontally via horizontal deflection plates 24. In addition to electrical readout, the information written on the storage target is visibly displayed through transparent support member 50. During operation, the tube potentials are adjusted such that beam 22 has a relatively high velocity for writing and is capable of producing secondary electrons when it strikes storage dielectric 56. The area engaged by beam 22 is raised to the potential of collector electrodes 54 and target electrode 52 from ground level thus causing the dielectric target to phosphoresce thereat. These secondary electrons are then collected by collector electrodes 54, and the areas of storage dielectric engaged by beam 22 are positively charged so that flood electrons from flood guns 34 are attracted to these positively-charged areas; they emit secondary electrons at a ratio of one therefrom, the secondary electrons being collected via collector electrodes 54 adjacent the positively charged (written) areas of storage dielectric 56 thereby causing the information to be visually observed and to remain indefinitely for purposes of study or being photographed. The target can be erased in a conventional manner by pulsing the target electrode to raise the storage dielectric to the potential of the collector electrodes and then lowering it to ground level so that the flood electrons maintain it thereat until beam 22 writes information thereon again. Reference is made to the heretofore identified U.S. Pat. No. 3,531,675 for further information concerning the operation of bistable storage targets of this type.

At the same time that electron beam 22 forms the stored image on storage target 32, it also produces an electron image on fluorescent dots 54 which, like the phosphor storage dielectric layer 56, emits a light image corresponding to such electron image, but however dots 54 do not store such electron image. Thus, when the writing electron beam 22 is deflected across the surface of target 32, both a stored light image and a nonstored light image are formed simultaneously on the same general area of the display device.

As a result of target 32 having a combination of bistable storage dielectric material and fluorescent material having conductive characteristics, the electron images of extremely short rise time or high frequency signals, which cannot be stored because they are beyond the writing rate of the storage target, can still be seen on the fluorescent areas 54 of the target due to increased brightness of such target.

In addition, the high brightness fluorescent areas 54 can also be used for previewing a signal waveform with the voltage on target electrode 52 being adjusted below the minimum voltage necessary for storage until the desired waveform is observed, at which time the voltage on target electrode 52 may be increased to enable bistable storage of such previewed signal waveform on the bistable storage dielectric layer 56, because the fluorescent dots 54 now act as collector electrode means due to their conductive characteristics thereby collecting the secondary electrons which are emitted from the written area of the storage dielectric material.

When the writing electron beam 22 has formed the stored image, the writing beam may then be reduced in current so that it will not store on storage dielectric layer 56, and a slightly or greatly different image may be displayed in the same general area as the stored image. Such image may consist of a nonstored write through waveform trace or other graphic and/or alphanumeric information of slightly or greatly different form than the stored information, and the stored and nonstored information may repeatedly cross or coincide with each other. The reduced current non-store image is produced on the fluorescent dots 54, which are capable of producing higher brightness than was formerly obtained from such reduced current. Fluorescent dots 54 may be separately optimized for nonstored write through brightness, because dots 54 are not being utilized for storage operation.

Different color of the nonstored information appearing on the fluorescent dots 54 from the stored information appearing on storage dielectric layer 56 can be provided by selection of the material from which the fluorescent dots are to be formed. Thus, a color contrast can be provided between the stored and nonstored information for ease of comparison therebetween.

The combined storage target of the present invention can also be operated as a high brightness fluorescent target of fast writing rate when storage is not desired. The brightness and writing rate in such nonstorage mode of operation will be reduced in accordance with the ratio of the area of the fluorescent dots to that of the storage dielectric layer. If the storage area of the target is substantially less than the fluorescent area, this target structure will provide a no penalty non-storage mode of operation presenting information having a brightness that is only slightly reduced compared to a conventional high performance fluorescent target structure. Depending on the desired operation of the storage tube will determine the ratio of storage dielectric material to that of fluorescent material. Making the fluorescent dots thicker will also increase brightness of the nonstored information.

Figure 2:
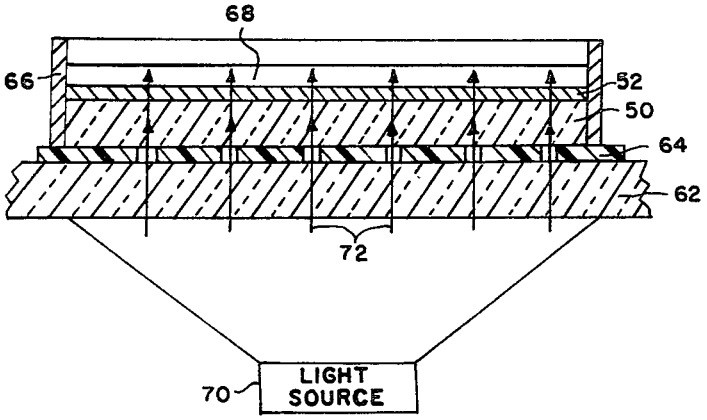
FIG. 2 is a cross-sectional view illustrating the fabrication of the conductive dot pattern on the conductive layer of a support member.

Attention is directed to FIGS. 2–6 for a description of the fabrication of the storage target 32. As shown in FIG. 2, a transparent member 62 has a photomask 64 which has a hole pattern disposed thereon. Transparent support member 50 with transparent conductive layer 52 thereon is positioned on photomask 64. A frame 66 is disposed around the periphery of support member 50 and a photopolymerizable slurry 68 of polyvinyl alcohol, water, ammonium dichromate, fluorescent particles (2–10 microns) and isopropyl alcohol is poured onto conductive layer 52.

A number of fluorescent materials can be used in slurry 68 to form dots 54 and these are conventional phosphors such as P-2, P-4, P-6, P-11, P-15, P-20, P-22B, P-22G, P-23, P-24, P-28 and P-31. In order for the dots to operate as collector electrode means, they will typically fall within the range of $10^1$ to $10^7$ ohm-cm. conductivity; the closer to $10^1$ ohm-cm., the better the conductivity. If it is desired to make the fluorescent material more conductive, metal particles (2–5 microns) can be added to the fluorescent material up to about one-half the total amount of material to form the collector dots; however the addition of metal particles and the amount added will determine the reduced brightness of the write through mode of operation. Typical metal particles that can be used are cobalt, nickel, silver, gold and the like.

Collimated light source 70 is utilized to transmit light rays 72 through transparent member 62, the holes in photomask 64, support member 50, conductive layer 52 and into slurry 68 so that light activates slurry 68 thereby polymerizing the polyvinyl alcohol in these areas.

The frame 66 is removed and the target structure is washed with water which removes the non-activated slurry and leaves behind a pattern of fluorescent dots.

Figure 3:
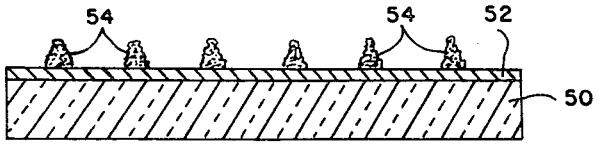
FIG. 3 is a cross-sectional view of the conductive dots on the conductive layer of the support member.
Figure 5:
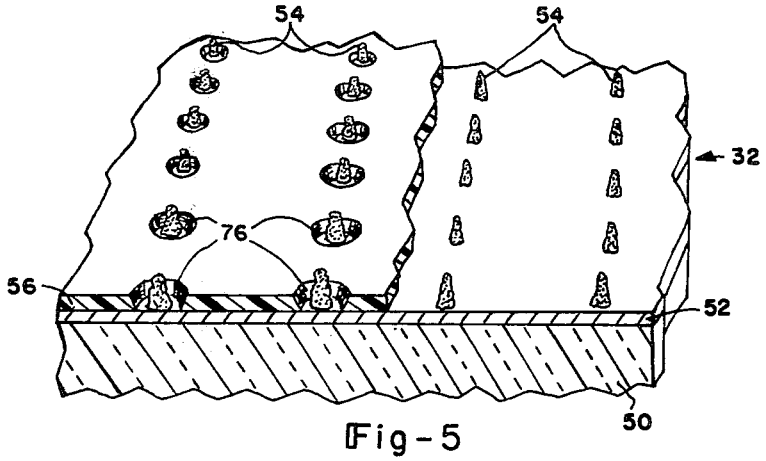
FIG. 5 is a perspective view, partly broken away and partly in cross section, of the completed storage target structure.

A shrinking agent can be applied to the target structure such as acetone, aqueous ammonium sulfate, alcohols or other hydrophyllic agents and this shrinking agent shrinks the fluorescent particles into a denser mass by rapid extraction of water thereby providing fluorescent dots 54 defining a distinct dot pattern on conductive layer 52 as illustrated in FIGS. 3 and 5. The target structure is then dried.

Figure 4:
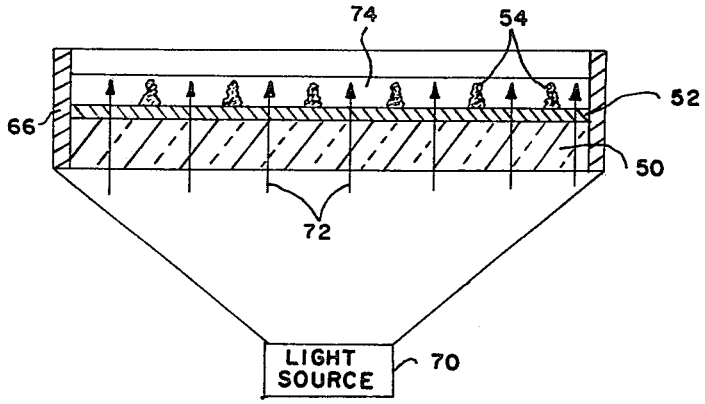
FIG. 4 is a cross-sectional view of the fabrication of the dielectric storage target.

A photopolymerizable slurry 74 of polyvinyl alcohol, water, dimethyl sulfoxide, ammonium dichromate and P-1 phosphor admixed with yttrium oxide or yttrium oxysulfide or rare earth activated yttrium oxide or yttrium orysulfide is introduced onto conductive layer 52 and dots 54 as shown in FIG. 4, whereafter collimated light source 70 transmits light rays 72 through support member 50, conductive layer 52 and into slurry 74 and the light rays activate slurry 74 in the areas where no dots are located thereby polymerizing the polyvinyl alcohol in these areas.

As can be discerned, no photomask is needed for this operation because the conductive fluorescent dots provide an integral photomask so that in the area of each conductive dot, no polymerization of the polyvinyl alcohol will take place.

The structure is washed with water which removes the nonactivated slurry and leaves behind a layer of light activated slurry defining a storage dielectric layer. This target structure then can be soaked by the shrinking agent used to shrink the conductive particles of the dots, and this shrinking operation shrinks the dielectric layer into a more dense configuration so that the dielectric surrounding each dot is shrunk back away therefrom thereby exposing a large area of each dot. While the photopolymerizable material for formulating the pattern of conductive collector segments and dielectric layer is in the form of a slurry, it can be in the form of a photopolymerizable dry film. As can be discerned from FIGS. 5 and 6, the area of the storage dielectric layer 56 surrounding each of dots 54 slopes upwardly and away from the dots defining an annular surface 76 therearound and best defined as being in the form of a beveled hole; hence the increased collector area provided by each collector dot 54 for more effectively collecting the secondary electrons that are emitted from storage dielectric layer 56. The dots 54 also extend above the outer surface of dielectric storage layer 56 about one-fourth the height of the dots. However, so long as sufficient area of dots 54 is exposed, they need not extend beyond the outer surface of layer 56.

After the storage target structure has been shrunk, it is baked in an oven at a suitable temperature to remove organic binders and leave the dielectric storage layer comprising essentially phosphor material. The storage target is now completed and is assembled in position on envelope 12 in accordance with conventional frit-sealing techniques with the support member defining the faceplate.

The dot pattern of dots 54 representing the collector electrode structure is preferably such that the center-to-center distance between adjacent dots is less than the diameter of electron beam 22 and this provides improved collector means for collecting secondary electrons, optimum resolution of the target, elimination of trace shadowing and improved visible display and readout accuracy of the stored information on the bistable storage target. The collection efficiency of secondary electrons by collector dots 54 is increased due to larger surface area and the control of the phosphor layer 56 surrounding the dots. This provides faster writing rate and improved luminance of the target. The life of the storage target is increased because the target operates at a lower operating potential since target degradation is slower at lower operating potentials. The use of the conductive fluorescent material as collector electrode means provides for brighter write through operation, and, depending on the fluorescent material selected, will provide color contrast between the stored and unstored information that is displayed.

FIG. *7a* illustrates an embodiment of the storage target wherein the collector segments **54*a* of particulate conductive fluorescent material are continuous and generally wedge-shaped protrusions that have their bases connected to conductive layer 52*a* and their apices extending above the outer surface of dielectric layer 56*a***. Thus, alternate rows of the dielectric layer and conductive collector segments define the target structure of FIG. *7a*. Particulate collector segments **54*b*** can also be discontinuous as illustrated in FIG. *7b*, and the dielectric layer **56*b*** is continuous in the areas where the collector segments are not continuous.

The areas of the dielectric layer **56*a* and 56*b* adjacent the collector segments 54*a* and 54*b* are beveled to provide greater collector area in the same manner as the collector dot pattern of FIGS. 2–6**.

The target structures of FIGS. *7a* and *7b* are fabricated in the same manner as that of FIGS. 2–6 and the collector segments of conductive particules can take any configuration as desired to achieve the intended result.

The embodiments hereinbefore described are directed to a planar support member having a thin layer of conductive coating thereon and on which the conductive particles defining the collector dots or collector segments are connected, a layer of dielectric storage material covers the conductive layer with the dielectric layer adjacent the dots or segments being provided with beveled surface means, and the apices of the dots or segments extending above the top or outer surface of the dielectric layer thereby defining a storage target of planar construction.

Figure 8:
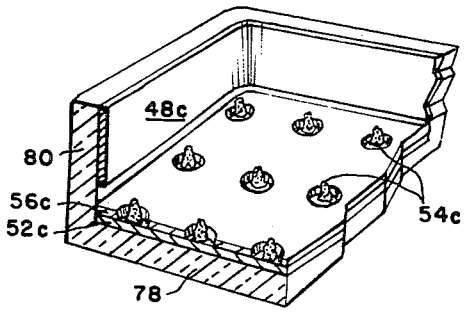
FIG. 8 is a perspective view of a corner of a front panel of a curved face plate for a large-viewing cathode ray tube.
Figure 6:
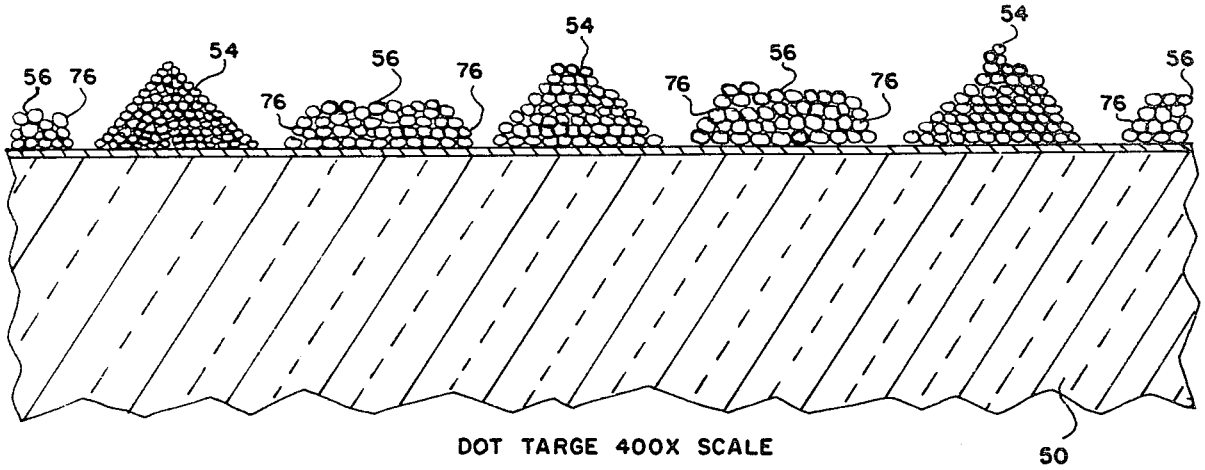
FIG. 6 is an enlarged cross section of a part of the storage target of FIG. 5.
Figures 7A, 7B:
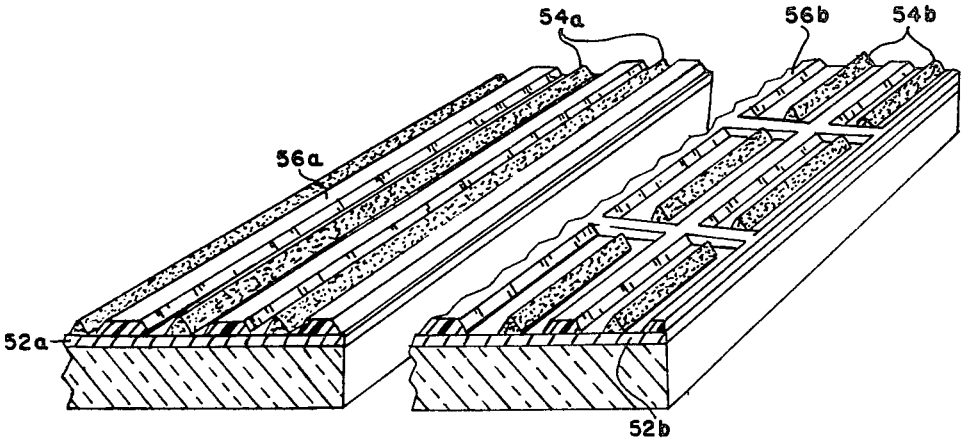

In the embodiment of FIG. 8, a glass front panel 78 has curved inner and outer surfaces with the inner surface having a conductive coating 52*c*, conductive collector dots 54*c* and dielectric layer 56*c*, which is fabricated in the same manner as hereinbefore described. Front panel 78 includes an integral wall 80 for securing onto the tube envelope of a larger cathode ray tube which has collimating electrode 48*c* disposed on the inside surface thereof. Thus, the embodiment of FIG. 8 is directed to a curved storage target for use in conjunction with storage cathode ray tubes having a large viewing area.

The storage target of the present invention is easier to fabricate and therefore is more economical. The support member with conductive layer thereon is reclaimable, because dielectric layer and/or conductive collector pattern can be removed so that the support member with conductive layer thereon is reusable to fabricate a new storage target. Better control can be exercised over the fabrication of the present storage targets therefore resulting in better production yields.

While preferred embodiments of the present invention have been illustrated and described, it will be apparent that changes and modifications may be made to this invention without departing therefrom in its broad aspects. The appended claims therefore cover all such changes and modifications as fall therewithin.

The invention is claimed in accordance with the following:

1. A cathode ray storage tube comprising:

an insulative transparent support member having a transparent conductive layer on an inside surface of said support member, said inside surface being smooth and nonanomalous;

connection means for providing said conductive layer with a predetermined voltage level;

a continuous dielectric layer of fluorescent material for storing a viewable charge pattern thereon, said layer being located on one side of said conductive layer;

a multiplicity of spaced conductive collector electrodes in the form of particulate fluorescent material having inner ends connected to said conductive layer, said collector electrodes extending from said conductive layer through said dielectric layer at least to an opposite side thereof to provide an equipotential surface on said opposite side of said dielectric layer at substantially the same voltage level as said conductive layer, said dielectric layer being substantially continuous except where interrupted by said collector electrodes; and means for emitting electrons toward and onto the opposite side of said dielectric layer and for establishing an illuminated electron image on said fluorescent collector electrodes onto which said viewable charge pattern is established and for directing low velocity electrons at said opposite side for driving selected areas of said dielectric layer toward one of two stable potentials whereby secondary electrons are emitted from said viewable charge pattern and collected by said collector electrodes to retain said charge pattern thereon.

2. A cathode storage tube according to claim 1 wherein said inside surface is planar.

3. A cathode ray storage tube according to claim 1 wherein said inside surface is curved.

4. A cathode ray storage tube according to claim 1 wherein said multiplicity of conductive collector electrodes comprises dots having a substantially conical configuration.

5. A cathode ray storage tube according to claim 1 wherein areas of said dielectric layer adjacent said conductive collector electrodes have beveled surfaces.

6. A cathode ray storage tube according to claim 1 wherein said multiplicity of conductive collector electrodes comprise continuous segments.

7. A cathode ray storage tube according to claim 1 wherein said multiplicity of conductive collector electrodes comprises discontinuous segments.

8. A cathode ray storage tube according to claim 6 wherein said discontinuous segments are wedge-shaped.

9. A cathode ray storage tube according to claim 1 wherein said miltiplicity of conductive collector electrodes comprises a fluorescent material that emits a different color than that of said dielectric layer when both are engaged by said means for establishing the charge pattern and electron image.

10. A cathode ray storage tube according to claim 1 wherein metal particles are mixed with said particulate fluorescent material.

11. A storage target for a cathode ray tube having an envelope and an insulative transparent support member sealingly secured onto one end of said envelope, a transparent conductive layer on the inside surface of the insulative support member which is to be connected to a predetermined voltage level and a continuous dielectric layer of fluorescent material for storing a viewable charge pattern thereon disposed on the conductive layer, means in said envelope for emitting high speed electrons toward and onto said dielectric layer for establishing said viewable charge pattern on said dielectric layer and for directing low velocity electrons toward and onto said dielectric layer for driving selected areas of said dielectric layer defining said viewable charge pattern toward one of two stable potentials to retain said charge pattern thereon, the improvement comprising a multiplicity of spaced conductive collector electrodes in the form of particulate fluorescent material having inner ends connected to said conductive layer, said conductive layer being smooth and nonanomalous, said collector electrodes extending from said conductive layer through said dielectric layer at least to an opposite side thereof to provide an equipotential surface on said opposite side of said dielectric layer at substantially the same voltage level as said conductive layer for collecting secondary electrons emitted from said viewable charge pattern and for establishing a viewable electron image thereon by said low velocity electrons, said dielectric layer being substantially continuous except where interrupted by said collector electrodes.

12. A storage target according to claim 11 wherein the areas of said dielectric layer through which said collector electrodes extend comprise beveled holes.

13. A storage target according to claim 11 wherein said collector electrodes have a conical configuration.

14. A storage target according to claim 11 wherein the areas of said dielectric layer through which said collector electrodes extend comprise beveled channels.

15. A storage target according to claim 11 wherein said collector electrodes have a wedge-shaped configuration.

16. A storage target according to claim 11 wherein said fluorescent material will display a different color from that displayed by said dielectric layer.

17. A storage target according to claim 11 wherein metal particles are mixed with the particulate fluorescent material.

* * * * *